US005513954A

United States Patent [19]

Bourgeois

[11] Patent Number: 5,513,954

[45] Date of Patent: May 7, 1996

[54] MULTILAYER PUMP LINER

[75] Inventor: Ronald J. Bourgeois, Sandy, Utah

[73] Assignee: Envirotech Pumpsystems, Inc., Salt Lake City, Utah

[21] Appl. No.: 258,273

[22] Filed: Jun. 10, 1994

[51] Int. Cl.[6] ..... F04D 29/42

[52] U.S. Cl. ..... 415/197; 415/196

[58] Field of Search ..... 415/196, 197

[56] References Cited

U.S. PATENT DOCUMENTS

| | | | |
|---|---|---|---|
| 1,585,669 | 5/1926 | Hansen . | |
| 2,255,239 | 9/1941 | Allen | 415/197 |
| 2,736,265 | 2/1956 | Higgins . | |
| 3,115,097 | 12/1963 | Zagar et al. | 415/197 |
| 3,535,051 | 10/1970 | Turner | 415/196 |
| 3,551,067 | 12/1970 | Wissman | 415/197 |
| 3,732,028 | 5/1973 | Heynemanns et al. | 415/197 |
| 3,771,927 | 11/1973 | Schiller . | |
| 4,133,407 | 9/1978 | Grzina | 415/197 |
| 4,179,238 | 12/1979 | Ashworth | 415/197 |
| 4,264,271 | 4/1981 | Libertini . | |
| 4,535,326 | 8/1985 | Mullins et al. . | |
| 4,722,664 | 2/1988 | Wissman | 415/197 |
| 4,802,818 | 2/1989 | Wiggins et al. | 415/197 |
| 4,917,571 | 4/1990 | Hyll et al. | 415/197 |
| 4,974,998 | 12/1990 | Heineman | 406/97 |
| 4,984,966 | 1/1991 | Grzina | 415/197 |
| 5,127,800 | 7/1992 | Hyll et al. | 415/197 |
| 5,197,863 | 3/1993 | Dardis et al. . | |

FOREIGN PATENT DOCUMENTS

| | | | |
|---|---|---|---|
| 13677 | 7/1891 | United Kingdom | 415/197 X |

*Primary Examiner*—Edward K. Look
*Assistant Examiner*—Michael S. Lee
*Attorney, Agent, or Firm*—R. Neil Sudol; Henry D. Coleman

[57] ABSTRACT

A liner member for a pump comprises an inner layer of a rigid abrasion resistant material and an outer layer of an elastomer material adhesively bonded to the inner layer and forming a backing therefor. One or more metal connectors are embedded in the elastomer layer for connecting the elastomer layer (and concomitantly the abrasion resistant inner layer) to a pump casing so that the elastomer layer is sandwiched between the inner layer and the pump casing.

20 Claims, 1 Drawing Sheet

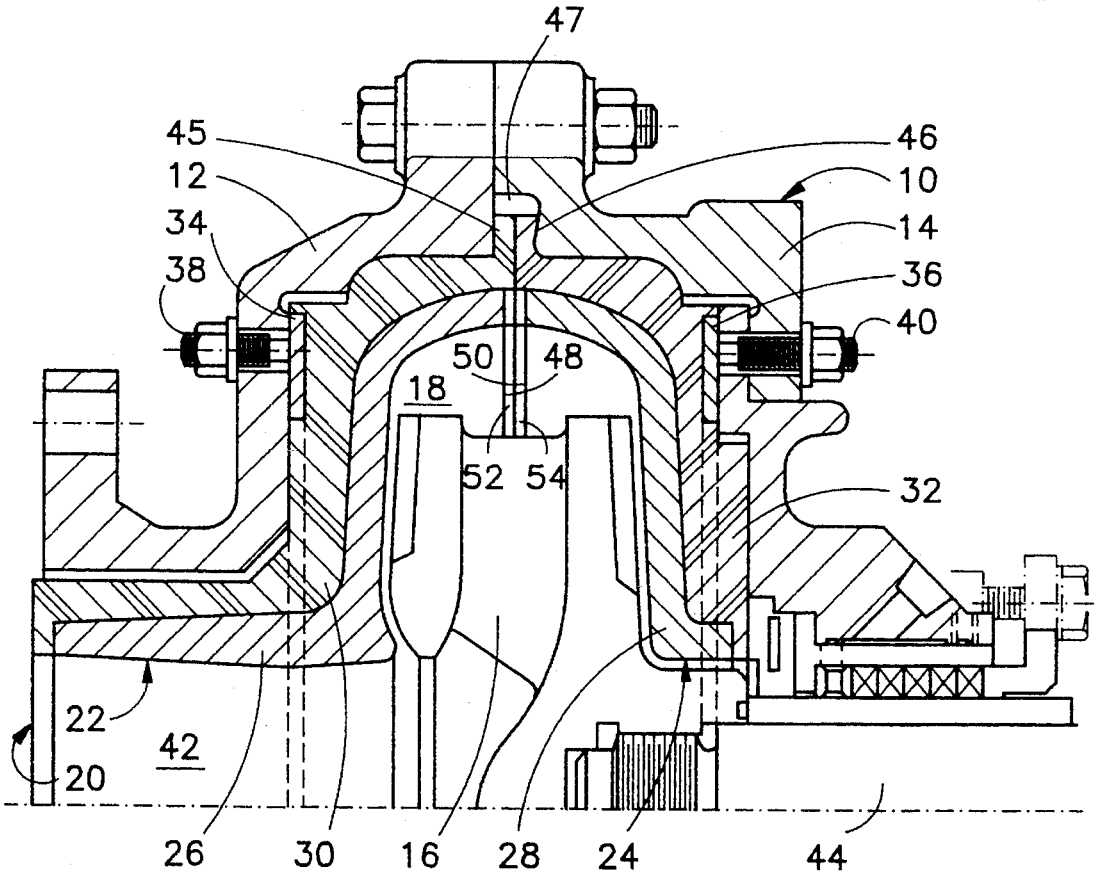
47
45
46
12
10
34
14
38
36
40
50
48
18
52
54
32
22
42
20
26
30
16
28
24
44

MULTILAYER PUMP LINER

BACKGROUND OF THE INVENTION

This invention relates to a pump and to a pump liner. More particularly, this invention relates to a multilayer pump liner.

Pump liners generally comprise rubber layers along the inner surfaces of the pump casings. In a recent departure from this practice, a pump is provided with a metal liner which is spaced from the pump casing and bolted thereto. In manufacture, this liner is cast, annealed, machined and heat treated. These production steps are time consuming and result in an expensive liner and pump.

SUMMARY OF THE INVENTION

A pump comprises, in accordance with the present invention, a pump casing, an impeller rotatably mounted to the casing, an inner liner layer of a rigid abrasion resistant material, and an outer liner layer of an elastomer material bonded to the inner layer and forming a backing therefor. At least one connector couples the elastomer layer to the pump casing so that the elastomer layer is sandwiched between the inner layer and the pump casing.

Preferably, the connector includes a mounting plate embedded in the elastomer layer of the liner. The mounting plate is embedded in the elastomer layer during a molding process wherein the elastomer layer is formed along an outer surface of the abrasion resistant layer. The mounting plate is generally annular, so as to surround a suction inlet or a drive shaft of the pump.

Where the casing includes a plurality of casing parts fastened to one another, the pump further comprises a seal connected to the elastomer layer and extending between contiguous ones of the casing parts for forming a seal therebetween. This seal may take the form of an outwardly extending flange receivable into a recess between the contiguous casing parts.

Generally, it is contemplated that the inner, abrasion resistant liner layer includes a plurality of liner parts. In small pumps, there are generally two liner halves, whereas larger pumps will include four or more liner parts. Where the inner liner layer includes a plurality of liner parts made of the rigid abrasion resistant material, the liner parts are provided along respective outer surfaces with respective elastomer layers which together form the outer liner layer. Thus, the liner parts have abutting faces coated with the elastomer material. This elastomeric coating of the abutting faces facilitates the manufacturing process and reduces costs by reducing the required precision.

Pursuant to the invention, a liner member for a pump comprises an inner layer of a rigid abrasion resistant material and an outer layer of an elastomer material bonded to the inner layer and forming a backing therefor. One or more connectors are provided on the outer layer for connecting the outer, elastomer layer (and concomitantly the inner layer) to a pump casing so that the elastomer layer is sandwiched between the inner layer and the pump casing.

According to another feature of the present invention, the liner further comprises a sealing element connected to the elastomer layer for forming a seal in the pump casing upon assembly of the liner and the pump casing. The seal may include an outwardly extending flange receivable into a recess in the pump casing.

Where the liner member is a liner part and the inner layer has a transversely oriented surface juxtaposable to an analogous surface of another liner part in forming an entire liner, the outer layer is provided with an integral runner extending over the transversely oriented surface. As mentioned above, this runner reduces the precision required in forming the inner liner layer.

According to further features of the present invention, the inner layer is made of high chrome iron or, alternatively, ceramic material or other abrasion resistant materials.

During manufacture, the iron layer is cast, heat treated and then placed in a mold for forming the elastomer backing layer on the iron. The mold is preferably provided with an elastomer insert for supporting the cast iron and absorbing stresses during a high-pressure, high-temperature molding process. The elastomer insert also serves to space the transversely oriented faces of the iron part from inner surfaces of the mold, thereby permitting the formation of the elastomer runners on those transversely oriented faces.

A multilayer pump liner in accordance with the present invention has an abrasion resistant inner surface and is relatively inexpensive to manufacture. The abrasion resistant inner layer need not be precisely machined for purposes of attaching it to a pump casing. Because the elastomer backing layer is compressible, the fitting of the liner to the pump casing is facilitated.

BRIEF DESCRIPTION OF THE DRAWING

The sole figure of the drawing is a partial cross-sectional view of a pump provided with a liner in accordance with the present invention.

DETAILED DESCRIPTION

As illustrated in the drawing, a pump of the general type marketed by EnviroTech Pumpsystems of Salt Lake City, Utah, under the trademark ASH PUMP® comprises a pump casing 10 including a suction casing half 12 and a drive casing half 14. An impeller 16 is rotatably mounted to the casing 10 for forming a ring (not shown) of pumped fluidic material in a pump cavity 18.

The pump shown in the drawing is provided with a liner 20 including a suction liner part 22 and a drive liner part 24. Each liner part 22 and 24 includes an inner layer 26 and 28 made of a rigid abrasion resistant material such as high chrome iron or ceramic and an outer layer 30 and 32 of an elastomer material. The elastomer layer 30 and 32 is bonded to the respective abrasion resistant inner layer 26 and 28 to form a backing therefor.

Each elastomer backing layer 30 and 32 is provided with a connector or mounting plate 34 and 36 in the form of a ring or annular section embedded in the respective elastomer backing layer. Mounting plates 34 and 36 are fastened via respective pluralities of bolts 38 and 40 to suction casing half 12 and drive casing half 14, respectively, thereby attaching liner parts 22 and 24 to casing 10. Elastomer layers 30 and 32 define a backing layer which is sandwiched between abrasion resistant inner layers 26 and 28 and pump casing 10.

During manufacture, each mounting plate 34 and 36 is embedded in the respective elastomer backing layer 30 and 32 in a molding process wherein the elastomer layer 30 or 32 is formed along an outer surface of the abrasion resistant layer 26 or 28. Mounting plate 34 surrounds a suction inlet 42 while mounting plate 36 encircles a drive shaft 44.

As further illustrated in the drawing, elastomer layers 30 and 32 are formed with outwardly extending flanges 45 and 46 which are received in a recess 47 formed between contiguous casing halves 12 and 14. Flanges 45 and 46 perform a sealing function and replace gaskets which are normally used in conventional pumps.

Abrasion resistant liner parts 22 and 24 each have at least one transversely oriented surface 48 and 50 juxtaposed to and essentially abutting the analogous surface 50 and 48 of another liner part 24 and 22. The transversely oriented surfaces 48 and 50 are covered by respective transversely and inwardly extending runner portions 52 and 54 of elastomer layers 30 and 32. Runner portions 52 and 54 are integral with elastomer layers 30 and 32 and formed therewith during the molding process by spacing transversely oriented surfaces 48 and 50 from a wall of a mold.

The provision of elastomer backing layers 30 and 32 with runner portions 52 and 54 on abrasion resistant inner liner layers 26 and 28 reduces the precision required in forming the inner liner layers and thereby significantly decreases manufacturing costs.

It is to be noted that in large pumps, liner parts 22 and 24 may each be divided into two or more liner components for purposes of facilitating manufacture of the liner and assembly of the pump. In small pumps, there are generally two liner halves, whereas larger pumps will include four or more liner parts.

A mold for forming elastomer backing layer 30 or 32 on preformed inner layer 26 or 28 is preferably provided with an elastomer insert for supporting the inner layer and absorbing stresses during a high-pressure, high-temperature molding process. The elastomer mold insert also serves to space the transversely oriented surface 48 or 50 of inner layer 26 or 28 from an inner surface of the mold, thereby permitting the formation of elastomer runner portions 52 and 54 on those transversely oriented surfaces.

Abrasion resistant inner layers 26 and 28 of a multilayer pump liner in accordance with the present invention need not be precisely machined for purposes of attaching it to pump casing halves 12 and 14. Because the elastomer backing layer is compressible, the fitting of the liner to the pump casing is facilitated.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A liner member for a pump, comprising:

an inner layer of a rigid abrasion resistant material;

an outer layer of an elastomer material bonded to said inner layer and forming a backing therefor; and connection means disposed solely on an outer side of said outer layer, opposite said inner layer, for connecting said outer layer and said inner layer to a pump casing so that said outer layer is sandwiched between said inner layer and the pump casing, said inner layer being attached to said connection means, and thus to said pump casing, only via said outer layer.

2. The liner member defined in claim 1 wherein said connection means includes a mounting plate.

3. The liner member defined in claim 2 wherein said mounting plate is embedded in said outer layer.

4. The liner member defined in claim 3 wherein said mounting plate is annular.

5. The liner member defined in claim 1, further comprising sealing means connected to said outer layer for forming a seal in the pump casing upon assembly of the liner and the pump casing.

6. The liner member defined in claim 5 wherein said sealing means includes an outwardly extending flange receivable into a recess in the pump casing.

7. The liner member defined in claim 1 wherein the liner member is a liner part and said inner layer has a transversely oriented surface juxtaposable to an analogous surface of another liner part in forming an entire liner, said outer layer being provided with an integral runner extending over said transversely oriented surface.

8. The liner member defined in claim 1 wherein said inner layer is made of high chrome iron.

9. The liner member defined in claim 1 wherein said inner layer is made of ceramic material.

10. A liner part for a pump, comprising:

an inner layer of a rigid abrasion resistant material; and an outer layer of an elastomer material bonded to said inner layer and forming a backing therefor, said inner layer having a transversely oriented surface juxtaposable to an analogous surface of another liner part in forming an entire liner, said outer layer being provided with an integral runner extending over said transversely oriented surface.

11. The liner part defined in claim 10, further comprising connection means on said outer layer for connecting said outer layer to a pump casing so that said outer layer is sandwiched between said inner layer and the pump casing.

12. The liner part defined in claim 11 wherein said connection means includes a mounting plate.

13. The liner part defined in claim 12 wherein said mounting plate is embedded in said outer layer.

14. The liner part defined in claim 13 wherein said mounting plate is annular.

15. The liner part defined in claim 10, further comprising sealing means connected to said outer layer for forming a seal in the pump casing upon assembly of the liner and the pump casing.

16. The liner part defined in claim 15 wherein said sealing means includes an outwardly extending flange receivable into a recess in the pump casing.

17. A pump comprising:

a pump casing;

an impeller rotatably mounted to said casing;

an inner liner layer of a rigid abrasion resistant material;

an outer liner layer of an elastomer material bonded to said inner layer and forming a backing therefor; and connection means for connecting said outer layer to said pump casing so that said outer layer is sandwiched between said inner layer and the pump casing;

said inner liner layer including a plurality of liner parts made of said rigid abrasion resistant material, said liner parts being provided along respective outer surfaces with respective elastomer layers together forming said outer liner layer, said liner parts having abutting faces provided with said elastomer material.

18. The pump defined in claim 17 wherein said inner layer is attached to said connection means only through said outer liner layer.

19. The pump defined in claim 17 wherein said connection means includes a mounting plate embedded in said outer layer and bolted to said pump casing.

20. The pump defined in claim 17 wherein said inner liner layer includes a plurality of liner parts made of said rigid abrasion resistant material, said liner parts being provided along respective outer surfaces with respective elastomer layers together forming said outer liner layer, said liner parts having abutting faces provided with said elastomer material.

* * * * *